US012090543B2

(12) United States Patent
Figatti et al.

(10) Patent No.: US 12,090,543 B2
(45) Date of Patent: Sep. 17, 2024

(54) PUNCHING APPARATUS

(71) Applicant: SALVAGNINI ITALIA S.P.A., Sarego (IT)

(72) Inventors: Diego Figatti, Sarego (IT); Stefano Saggin, Sarego (IT)

(73) Assignee: SALVAGNINI ITALIA S.P.A., Sarego (IT)

( * ) Notice: Subject to any disclaimer, the term of this patent is extended or adjusted under 35 U.S.C. 154(b) by 275 days.

(21) Appl. No.: 17/770,748

(22) PCT Filed: Oct. 19, 2020

(86) PCT No.: PCT/IB2020/059803
§ 371 (c)(1),
(2) Date: Apr. 21, 2022

(87) PCT Pub. No.: WO2021/079252
PCT Pub. Date: Apr. 29, 2021

(65) Prior Publication Data

US 2022/0362830 A1 Nov. 17, 2022

(30) Foreign Application Priority Data

Oct. 21, 2019 (IT) ..... 102019000019421

(51) Int. Cl.
*B21D 28/34* (2006.01)
*B21D 45/00* (2006.01)

(52) U.S. Cl.
CPC ..... *B21D 28/346* (2013.01); *B21D 45/006* (2013.01)

(58) Field of Classification Search
CPC ..... B21D 45/006; B21D 28/346
See application file for complete search history.

(56) References Cited

U.S. PATENT DOCUMENTS 3,763,689 A * 10/1973 Bridges ..... B23D 15/14 72/451
5,647,256 A * 7/1997 Schneider ..... B21D 45/006 83/140

(Continued)

FOREIGN PATENT DOCUMENTS

CN 101861217 10/2010
CN 105263648 1/2016

(Continued)

OTHER PUBLICATIONS

Office Action issued Aug. 22, 2022 in corresponding Indian Patent Application No. 202227021639.

(Continued)

*Primary Examiner* — Evan H MacFarlane
*Assistant Examiner* — Liang Dong
(74) *Attorney, Agent, or Firm* — Wenderoth, Lind & Ponack, L.L.P.

(57) ABSTRACT

A punching apparatus includes a punch holder and a punching tool. The punch holder includes a guiding body having a mounting cavity to slidably receive the punching tool and a driving assembly connected to the guiding body and provided with a beating element having first and second connecting ends coupled by a threaded coupling that enables a relative rotation for a linear movement of the punching tool with respect to the beating element. A stopping element has a first end fixed inside a connecting cavity in one of the connecting ends and arranged to receive the other connecting end and a second end inserted into a stopping cavity of the other connecting end and sliding inside the stopping cavity.

13 Claims, 4 Drawing Sheets

(56) References Cited

U.S. PATENT DOCUMENTS

| | | | |
|---|---|---|---|
| 6,276,247 | B1 | 8/2001 | Helda |
| 7,698,979 | B2 | 4/2010 | Sugizaki et al. |
| 8,806,998 | B2 | 8/2014 | Cappeller |
| 9,469,043 | B2 | 10/2016 | Sugizaki et al. |
| 9,878,363 | B2 | 1/2018 | Meneghetti |
| 10,144,046 | B2 | 12/2018 | Menegherti |
| 10,953,452 | B2 | 3/2021 | Banno et al. |
| 11,103,912 | B2 | 8/2021 | Meneghetti |

FOREIGN PATENT DOCUMENTS

| | | |
|---|---|---|
| CN | 106573286 | 4/2017 |
| CN | 105618810 | 7/2017 |
| CN | 108941370 | 12/2018 |
| CN | 109396248 | 3/2019 |
| EP | 0 532 147 | 3/1993 |
| JP | S56-105830 | 8/1981 |
| JP | 2008-513222 | 5/2008 |
| WO | 94/07663 | 4/1994 |

OTHER PUBLICATIONS

Office Action issued Mar. 24, 2023 in corresponding Chinese Patent Application No. 202080073580.0, with English-language Search Report.

Notice of Reasons for Refusal issued Aug. 29, 2023 in corresponding Japanese Patent Application No. 2022-523662 with machine translation.

International Search Report issued Feb. 9, 2021 in International (PCT) Application No. PCT/IB2020/059803.

* cited by examiner

PUNCHING APPARATUS

The invention relates to machines for working metal pieces and/or sheets and in particular regards to a punching apparatus that can be installed on a punching machine and allows to adjust and control the position of the punching tool positioned inside the relative punch holder, in particular following assembly after a sharpening operation of the said punching tool.

The use of punching machines provided with one or more punching apparatuses, each comprising a punch holder and a punching tool or punch, slidably and removably housed in the punch holder, is known in the field of metal sheets working and the like.

More precisely, the punch holder generally comprises a guiding body which has a mounting cavity adapted to axially slidably receive the punch and a driving assembly adapted to transmit the punching force from a ram of a press assembly of the punching machine to the punch. The driving assembly comprises a base element, which is fixed to the guiding body and slidably supports a beating element which is axially movable and provided with a first upper end adapted to interact with the ram of the press assembly and a second lower end that is couplable to a connecting end of the punch and is opposite an operating or cutting end of the latter.

The driving assembly further comprises elastic means, so-called "spring pack", which are interposed between the guiding body or the base element and the first upper end of the beating element and are arranged to reposition the latter in a raised position (in order to disengage the cutting tool from the machined piece) after driving of the ram.

In lieu of large, complex, and expensive standard punches, cutting tips or punch tips and respective punch holders or adapters can be used in punch apparatuses as punching elements. Punch tips having smaller sizes and therefore being cheaper are mounted inside the punch holder by means of specific tip holders or adapters, the latter being connected to the beating element.

Cutting tools, meaning both standard single-body punches and punch tips mounted on respective adapters, comprise at least one operating portion having a cutting end provided with one or more cutting edges and a connecting portion which generally has larger dimensions (diameter) of the operating portion and is arranged for the connection with the beating element or with the adapter.

The punch holder generally comprises an extractor element which is fixed to the end of the guiding body, is provided with an opening from which the cutting end of the cutting tool protrudes and is maintained in abutment with the workpiece by pressing it against an underlying punching die in order to facilitate the extraction of the cutting tool from the workpiece during retraction or return and to improve the quality of the punching and the accuracy of the workpiece positioning during the punching execution.

Several other configurations and embodiments of punching apparatuses are known, but generally the connection between the beating element of the driving assembly and the punching tool (punch or adapter supporting the punch tip) for forming the so-called punch assembly, is always carried out by means of a threaded coupling. In fact, this coupling allows to adjust a length of the punch assembly, i.e. to adjust the position of the cutting tool and more precisely of the cutting end with respect to the beating element, by rotating the latter with respect to the punch or punch holder.

The adjustment of the position of the cutting tool (punch or punch tip) with respect to the beating element, i.e. the adjustment of the length of the punch assembly, is necessary after mounting the cutting tool in the punch holder after the sharpening of the cutting edge(s) of the cutting end, a maintenance operation which must be carried out periodically following the progressive loss of cutting capacity of the tool due to wear in use.

However, the sharpening of the cutting tool results in a reduction in the overall length of the tool itself, more precisely the operating portion thereof, whereby once the tool is reassembled in the punch holder it must be suitably connected (directly or via the adapter) to the beating element, in particular by screwing the two components by a settled amount or length, so as to position the cutting end of the tool inside the punch holder in a settled position with respect to the beating element, i.e. forming a punch assembly having an settled length, to properly cut or punch the piece.

In fact, the working stroke of the ram is preset, defined based on the thickness of the sheet or piece to be cut/punched and a settled penetration depth of the cutting tool in the die below the piece. Therefore, the initial operating position and the final operating position of the cutting tool, and in particular of the cutting end thereof, are defined by the length of said working stroke.

An incorrect management of the adjustment of the length of the punch assembly can therefore lead on the one hand to an incorrect execution of the machining on the piece (insufficient penetration into the piece), and on the other to a damage of the cutting tool, the punch holder and also the punching machine.

The latter case occurs when excessive sharpening of the cutting tool is performed, beyond the maximum allowed limit, i.e. the length of the operating portion is excessively reduced, which becomes shorter than the working stroke of the ram.

The excessive reduction in the length of the cutting tool (operating portion) can therefore cause the cutting tool (in particular the main body thereof) to collide with the extractor element during the working stroke, damaging the extractor element and in some cases the entire punch holder and punching apparatus.

The excessive reduction in the length of the cutting tool further causes (in order to maintain the position of the cutting end unchanged) the reduction of the screwing or engagement portion of the threaded coupling between the beating element and the punch (or adapter), such screwing portion being insufficient to support and transmit the punching force exerted by the ram. More precisely, the engagement threads of the punch and the beating element can be damaged if excessively stressed in operation, requiring the replacement not only of the punch, but also of the beating element which must be disassembled from the punch holder.

To overcome these drawbacks, punching apparatuses are known which allow to adjust and control the length of the punch assembly and in particular the length of the engagement portion of the threaded coupling between the beating element and the punch (or adapter) by displaying by means of appropriate visual references the width of the final relative rotation angle between the beating element and the punch or by allowing to count the number of angular pitches (of known length) with which the beating element and punch are rotated with respect to each other, in both cases knowing the threading pitch of the threaded coupling.

These solutions allow an operator to know the amount of the adjustment performed and consequently the length of the punch assembly after the adjustment, i.e. the position of the cutting end, and avoid the drawbacks described above as long as he knows precisely, in addition to the stroke of the ram, the extent of the sharpening performed on the cutting tool, i.e. the length thereof, and the maximum and minimum lengths of the screwing portion of the threaded coupling between the beating element and the punch. The adjustment procedure is therefore quite laborious and requires a lot of care and attention from an experienced operator.

Furthermore, such known solutions do not prevent the operator from inadvertently making an incorrect adjustment to the length of the punch assembly.

WO 9407663 discloses a variable-length punching assembly, which allows to adjust the overall length of a punch, comprising an axially-adjustable operating element of the punch and a punch holder. The punch holder is at least partially contained in a guiding bush and is axially thrust by a loaded spring with respect to the guiding bush. The punching assembly comprises locking means operable in the locking position to lock the punch driving element with respect to the punch holder and prevent the adjustment of the length of the punch. The locking means comprise a locking component having at least n locking teeth which are engaged in a corresponding set of N first locking teeth made on the punch holder in both locking and releasing positions and in a plurality m×n of second locking teeth made on the axially adjustable punch driving element to provide m×n possible engagement orientations of the at least n locking teeth with respect to the axially adjustable punch driving element.

An object of the present invention is to improve the known punching apparatus for punching machines, in particular the punching apparatuses comprising a punch holder and a punching tool reversibly fixed to a beating element of the punch holder to form a punch assembly.

Another object is to obtain a punching apparatus which allows to control the adjustment of the length of the punch assembly, in particular the position of the punching tool with respect to the beating element, preventing incorrect adjustments which could cause damage to the cutting tool and/or punch holder.

A further object is to provide a punching apparatus in which the adjustment of the length of the punch assembly can be performed safely without risk of accidental errors even by an inexperienced operator.

Another object is to obtain a punching apparatus of simple, robust, and reliable construction.

These and other objects are achieved by a punching apparatus according to one or more of the claims set out below.

The invention can be better understood and implemented with reference to the attached drawings which illustrate an exemplifying and non-limiting embodiment thereof, in which.

Figure 1:
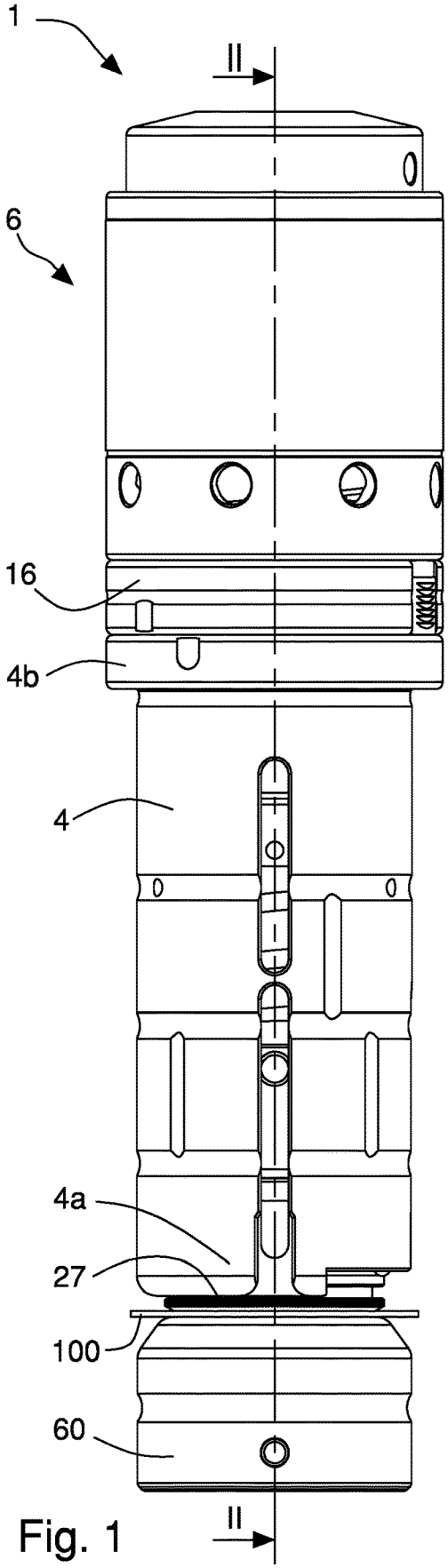
FIG. 1 is a front view of the punching apparatus of the invention associated with a punching die and a workpiece.

Referring to FIGS. 1 to 7, the punching apparatus 1 of the invention is illustrated, which can be associated with a punching machine, not illustrated, for performing cuts and punching on a piece 100, in particular a piece of sheet metal.

The punching apparatus 1 comprises a punch holder 2 and a punching tool 3. The punch holder 2 includes a guiding body 4 provided with a mounting cavity 5, in particular a through cavity and extending along a longitudinal axis X, adapted to slidably receive the punching tool 3 and a driving assembly 6 connected to the guiding body 4 and provided with a beating element 7 having a first operating end 8 arranged to interact with a ram of the punching machine and a first connecting end 9 coupled to a second connecting end 32 of the punching tool 3 by means of a threaded coupling. The latter allows a relative rotation between the beating element 7 and the punching tool 3 for linear movement of the latter with respect to the beating element 7 along an adjustment stroke C, between an initial adjustment position A and a final adjustment position B.

In the initial adjustment position A the engagement portion 20 of the threaded coupling that joins the two connecting ends 8, 32 of the beating element 7 and the punching tool has a maximum length L1, while in the final adjustment position B the engagement portion 20 has a minimum length L2. The minimum length L2 is such as to guarantee a number of engagement threads in the engagement portion 20 of the threaded coupling suitable to the force transmitted by the beating element 7 to the punching tool 3, i.e. such as to prevent them from being excessively stressed in operation and being damaged.

Anti-rotation means 63, 64 are provided to prevent rotation of the punching tool 3 with respect to the guiding body 4 when the beating element 7 is rotated about the longitudinal axis X. The anti-rotation means comprise, for example, a transverse pin 63 fixed to the punching tool 3, almost orthogonal to the longitudinal axis X, and slidably engaging by means of a protruding portion thereof with a longitudinal slot 64 made on a side wall of the guiding body 4.

The punching tool 3 comprises a second operating end 36 opposite the second connecting end 32, adapted to interact (in particular cut, drill, punch) with a cutting end **36*a* with a piece 100 and having a defined sharpening length Ls which is longer than the adjustment stroke C of the punching tool 3 with respect to the beating element 7**, between the initial adjustment position A and the final adjustment position B.

In operation, the beating element 7, 17 is driven by the ram of a press assembly of the punching machine so as to move the punching tool 3 linearly along the longitudinal axis X with respect to the guiding body 4 along a working stroke W between a non-operating internal position N and an operating external position T. In the non-operating internal position N of the punching tool 3 the second operating end 36 of the punching tool 3 is contained inside the punch holder 2, in particular inside the guiding body 4, while in the operating external position T the second operating end 36 partially protrudes from the punch holder 2 and inserts with the cutting end 36*a* thereof into the underlying punching die 60 so as to punch the piece 100.

The punch holder 2 is provided with an extractor element 27, of known type, fixed to a first end part 4*a* of the guiding body 4 from which the punching tool 3 protrudes, adapted to abut and press the piece 100 against the punching die 60 and provided with a respective opening for the exit of the second operating end 36 of the punching tool 3 when moved by the beating element 7 in the operating external position T.

The driving assembly 6, of a known type, comprises a base element 16 fixed to a second end part 4*b* of the guiding body 4 which is opposite the first end part 4*a* and is arranged to slidingly guide the beating element 7 along a longitudinal axis X. The driving assembly 6 further includes elastic means 28 interposed between the base element 16 and the first operating end 8 of the beating element 7 to return the latter to a raised position (corresponding to the non-operating internal position N of the punching tool 3) so as to extract the punching tool 3 from the piece 100 after the working.

The punching apparatus 1 further comprises a stopping element 10 having a first end 11 fixed inside a connecting cavity 15 made at one of the connecting ends 9, 42 of the beating element 7 or the punching tool 3 and arranged to receive the remaining connecting end 32 of the punching tool 3 or the beating element 7 and a second end 12 inserted into a stopping cavity 34 made at the remaining connecting end 32 and slidable inside said stopping cavity 34 during the linear movement between the initial adjustment position A and the final adjustment position B.

The second end 12 of the stopping element 10 is provided with a first stopping system 22 adapted to abut a second stopping system 35 provided at an opening of the stopping cavity 34 so as to prevent the stopping element 10 from disengaging from the stopping cavity and stopping the adjustment stroke C of the punching tool 3 in the final adjustment position B.

In the embodiment illustrated in FIGS. 1 to 7, the connecting cavity 15 is made in the first connecting end 9 of the beating element 7 and comprises an outer portion 15*a* that is threaded and adapted to receive and engage with the second connecting end 32, externally threaded, of the punching tool 3. The connecting cavity 15 of the first connecting end 9 of the beating element 7 further comprises an inner portion 15*b* adapted to receive, and fixed to, the first end 11 of the stopping element 10, while the second end 12 thereof is slidably housed in the stopping cavity 34 made in the second connecting end 32 of the punching tool 3.

The stopping element 10 is sized and fixed with its first end 11 inside the connecting cavity 15, so that the punch element 3 also in the final adjustment position B with respect to the beating element 7 and in the operating external position T with respect to the guiding body 4 does not collide with the second operating end 36 against said extractor element 27, as better explained in the following description.

The stopping element 10 has, for example, a cylindrical shape and the first stopping system 22 comprises an annular protrusion made on an edge of the second end 12 and adapted to be abutted by the second stopping system 35 provided in the stopping cavity 34 and comprising an elastic ring, in particular a split ring, housed in a respective inner annular groove made at the opening of the stopping cavity 34.

Similarly, the first end 11 of the stopping element 10 is fixed inside the inner portion 15*b* of the connecting cavity 15 by fixing means 14 comprising, for example, a respective elastic ring mounted on a first annular seat made on an outer wall of the first end 11 and engaging in an assembly configuration with a second annular seat made on an inner wall of the inner portion 15*b* of the connecting cavity 15.

In the embodiment illustrated in FIGS. 1 to 7, the punching tool 3 comprises a punch tip holder or adapter 31 provided with the second connecting end 32 and a punch tip 35 or cutting tip that is reversibly fixed to the punch tip holder 31, opposite the second connecting end 32 and provided with the second operating end 36 with the cutting end 36*a* adapted to interact with the piece 100.

More precisely, the punch tip holder 31 comprises a third connecting end 37 opposite the second connecting end 32 provided with a connecting seat 38 adapted to receive a connecting portion 39 of the punch tip 33 opposite the second operating end 36. The connecting seat 38 and the connecting portion 39 have, for example, a complementary truncated-conical shape and are coaxial to the longitudinal axis X of the punch holder 2.

In an assembled configuration, illustrated in FIGS. 1 to 7, the punch tip holder 31 and the punch tip 33 are fixed to one another by means of a screw 61. To this end, the stopping cavity 34 that is made in the second connecting end 32 of the punch tip holder 2 is a through cavity in order to allow the end 61 of the screw to be screwed into a threaded hole made on an upper wall of the connecting portion 39 of the punch tip 33. The stopping cavity 34 comprises a shoulder intended to abut the head of the screw 61.

The punch tip holder 31 is configured to be mounted on the respective beating element 7, the first connecting end 9 and the second connecting end 32 being complementary, and is capable of receiving in the connecting seat 38 one of a set or plurality of punch tips 33, each of which is adapted to perform a respective working on the piece 100.

In an initial operating step of the punching apparatus 1 of the invention, in which the punching tool 3 (more precisely the punch tip 33 in the example of the figures) is new and sharp, the latter is screwed to the beating element 7 so as to be arranged in the initial adjustment position A. In this initial adjustment position A the engagement portion 20 of the threaded coupling, which joins the two connecting ends 8, 32 of the beating element 7 and of the punching tool 3, has a maximum length L1, i.e. the second connecting end 32 of the punching tool 3 is completely inserted in the first connecting end 9 of the beating element 7 since the second operating end 36 of the punching tool 3 has a length equal to the maximum sharpening length Ls.

Figure 4:
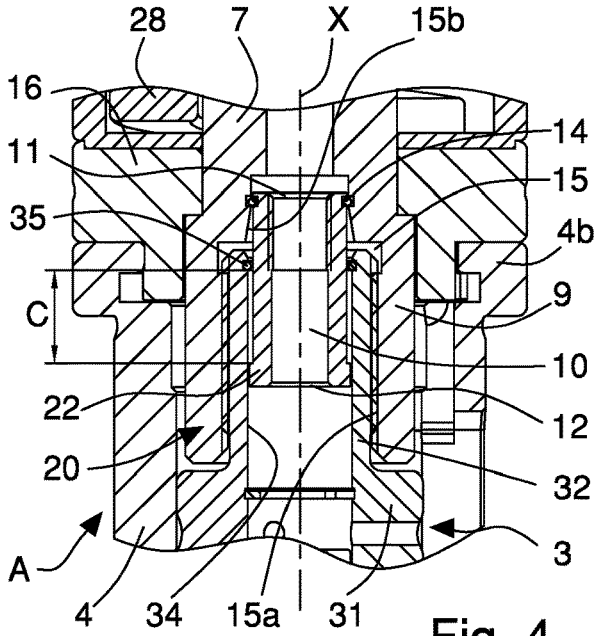
FIG. 4 is an enlarged detail of FIG. 2 illustrating a stopping element inside connecting ends of the beating element and the punching tool in the initial adjustment position.
Figure 7:
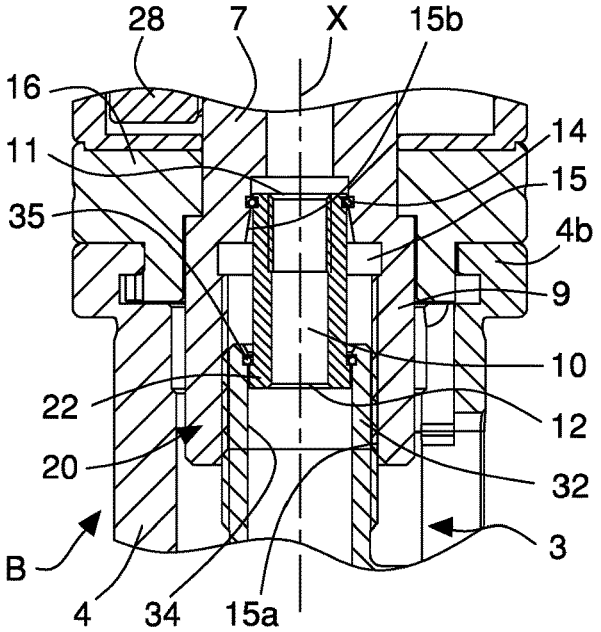
FIG. 7 is an enlarged detail of FIG. 5 illustrating the stopping element inside the connecting ends of the beating element and the punching tool in the final adjustment position.
Figure 2:
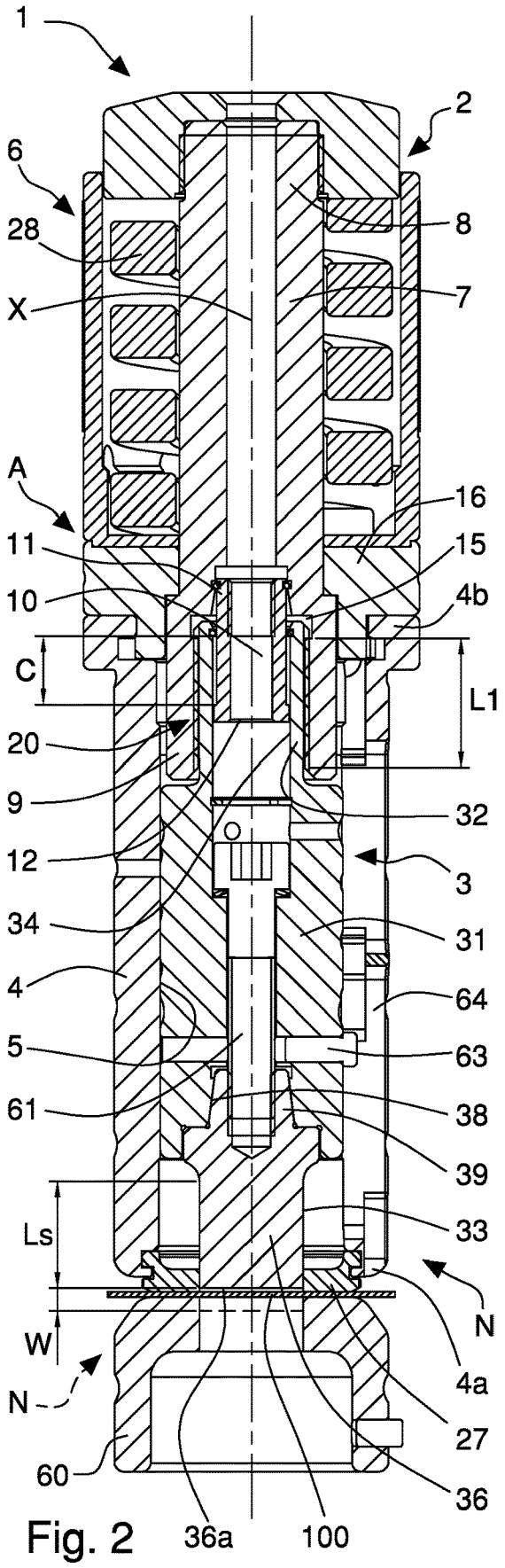
FIG. 2 is a section according to the plane II-II of FIG. 1 illustrating in particular a punch holder that slidably houses a beating element connected to a punching tool comprising a punch tip holder supporting a punch tip, in an initial adjustment position and in a non-operating internal position and, in dashed line, in an operating external position.
Figure 3:
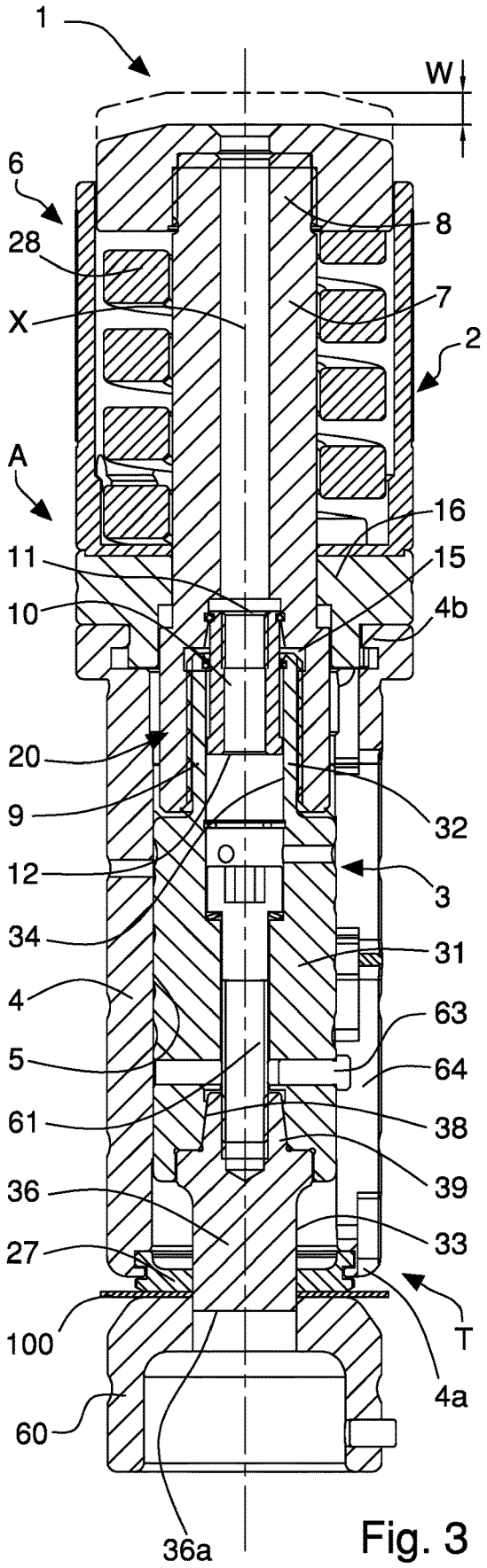
FIG. 3 is a section as in FIG. 2 illustrating the beating element connected to the punching tool in an operating external position and, in dashed line, in a non-operating internal position.
Figure 5:
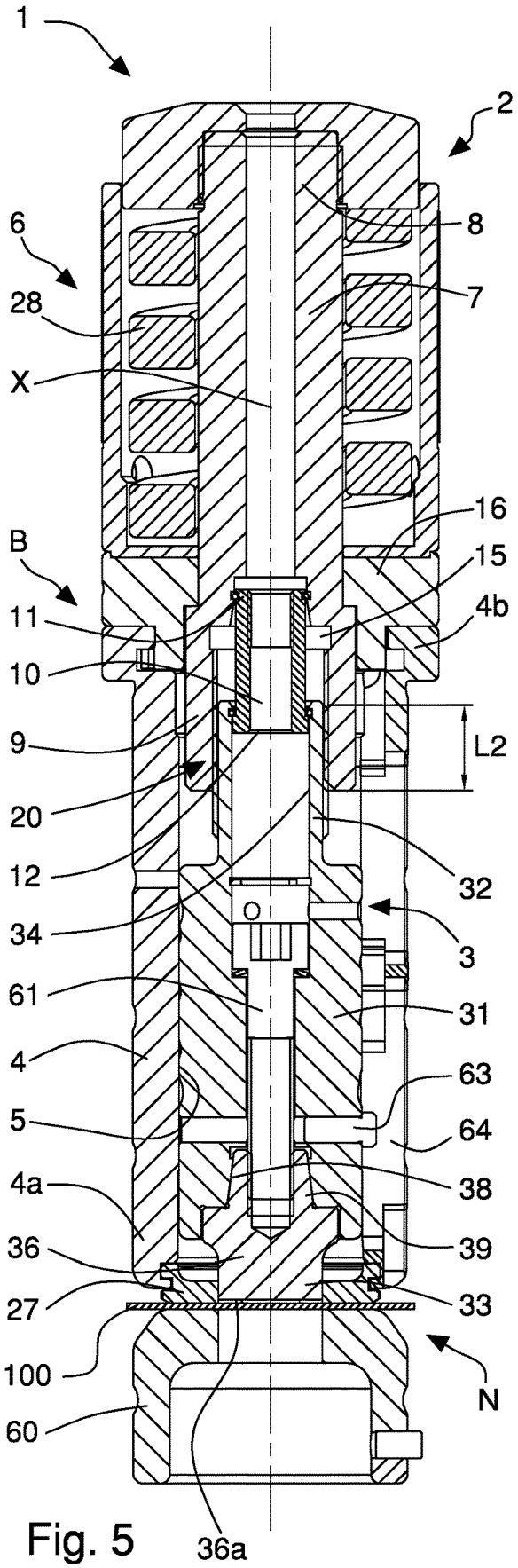
FIG. 5 is a section as in FIG. 2 illustrating the beating element connected to the punching tool in a final adjustment position and in the non-operating internal position.
Figure 6:
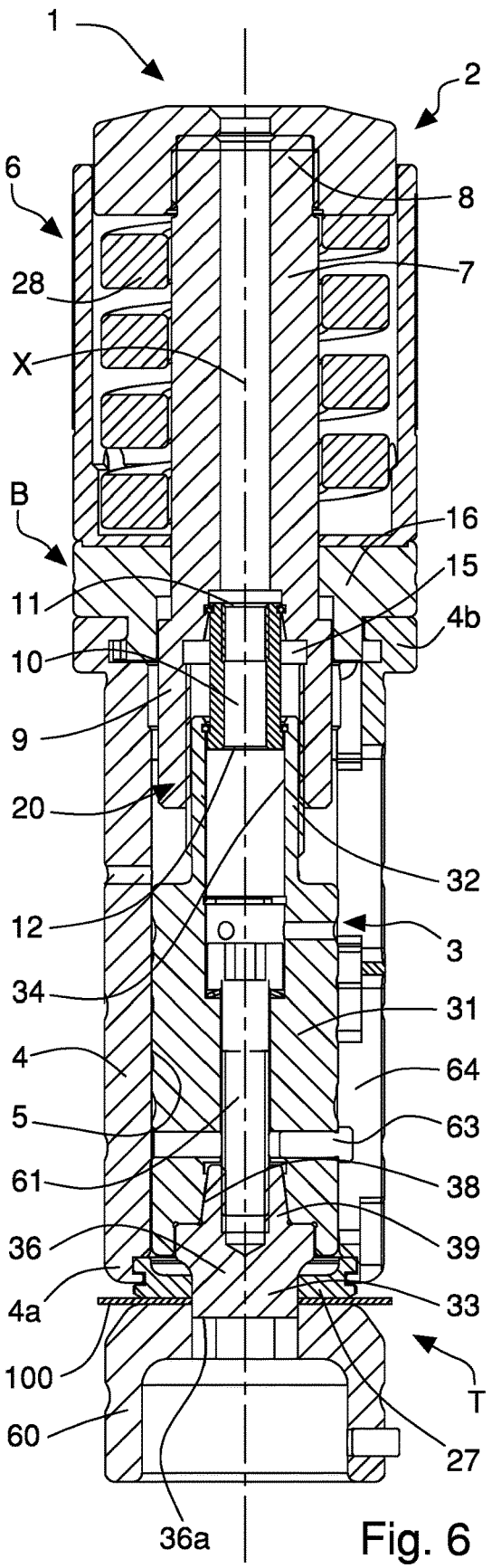
FIG. 6 is a section as in FIG. 5 illustrating the beating element connected to the punching tool in the final adjustment position and in the operating external position.

In the initial adjustment position A the distance between the first stopping system 22 of the stopping element 10 and the second stopping system 25 provided in the stopping cavity 34 is also maximum (FIGS. 2 to 4). In this initial adjustment position A, with the punching tool 3 having a maximum sharpening length Ls, in the working stroke W, between the non-operating internal position N and the operating external position T, the punching tool is able to correctly perform the cutting or punching of the piece 100.

The punching tool 3 (punch tip 33) during its operating life is subjected to periodic sharpening operations following which the length of its second operating end 36 progressively decreases.

In order to ensure that in the predefined working stroke W the beating element 7, driven by the ram of the press assembly of the punching machine, moves the second operating end 36, in particular the cutting end 36*a* thereof, between the non-operating internal position N and the operating external position T, so as to appropriately cut or punch the piece 100, the position of the punching tool 3 along the longitudinal axis X with respect to the beating element 7 must be adjusted by appropriately rotating the beating element about the longitudinal axis X. By measuring the number of rotations and/or rotation fractions and knowing the thread pitch of the threaded portion 20, it is possible to adjust and control the position of the punching tool 3 with respect to the beating element 7, i.e. the position of the second connecting end 32 inside the first connecting end 9 and thus the position of the cutting end 36*a*.

With progressive reduction of the length of the second operating end 36 of the punching tool 3, the length of the engagement portion 20 of the threaded coupling, which joins the two connecting ends 8, 32 and the distance between the first stopping system 22 of the stopping element 10 and the second stopping system 25 provided in the stopping cavity 34 decreases by the same value.

When adjusting the position along the longitudinal axis X of the punching tool 3 with respect to the beating element 7, after mounting following a sharpening operation, the stopping element 10 prevents the punching tool 3 from being screwed insufficiently to the beating element 7, i.e. it prevents the length of the engagement portion 20 of the threaded coupling from being less than the minimum length L2 in an incorrect mounting condition. In fact, below this minimum length (with a tolerance range of about 1 mm) the second operating end 36 collides with the extractor element 27 causing damage to the latter and to the whole punch holder 6 since the working stroke W is longer than the remaining length of the second operating end 36.

Such incorrect mounting condition is prevented by the locking element 10 since the first stopping means 11 thereof and second stopping means 35 of the second connecting end 32 abut each other, avoiding further displacement of the punching tool 3 away from the beating element 7, when the length of the engagement portion 20 of the threaded coupling is equal to the minimum length L2.

In this manner, if a punching tool 3 is sharpened excessively, reducing the length of its second operating end 36 below the defined sharpening length Ls, the punching tool 3 cannot be remounted on the punch holder 2, i.e. fixed to the beating element 7 and adjusted in the axial position so as to collide in operation against the extractor element 27.

Thanks to the punching apparatus 1 of the invention, it is therefore possible to control the position of the punching element 3 with respect to the beating element 7 and to prevent operators from making incorrect adjustments, in particular in the case of excessive sharpening of the punching element 3, which could damage the extractor element and/or the punch holder 1 in operation. Hence the adjustment can be performed safely without risk of accidental errors even by inexperienced operators.

The stopping element 10 further allows to have a minimum length L2 of the engagement portion 20 of the threaded coupling between the beating element 7 and the punching tool 3 capable of guaranteeing a number of engaged threads of this engagement portion 20 that is appropriate for the force which is transmitted by the beating element 7 to the punching tool 3, and prevents the engaged threads from being excessively stressed in operation and being damaged.

Moreover the punching apparatus 1, which is provided with a locking element 10 positioned inside the connecting ends 9, 32 of the beating element 7 and the punching tool 3, is of simple, robust, and reliable construction.

Figure 8:
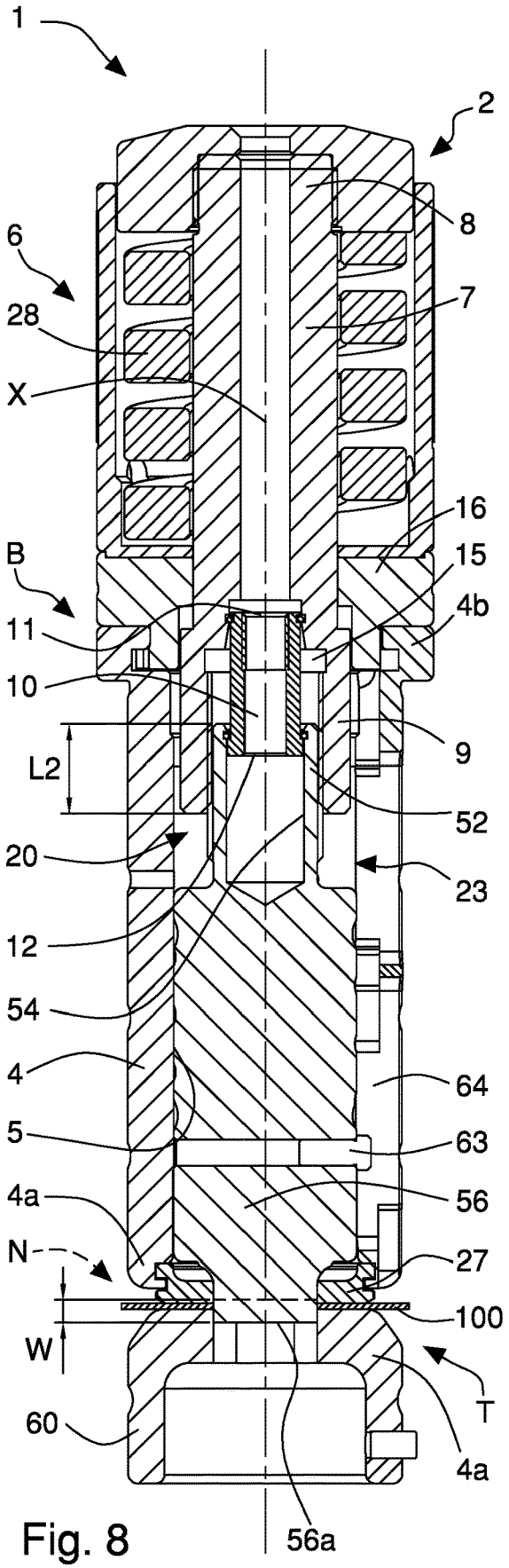
FIG. 8 is a section as in FIG. 2 illustrating a variant of the punching apparatus of the invention illustrating the beating element connected to a single-body punching tool in the final adjustment position and in the operating external position and, in dashed line, in the non-operating initial position.

With reference to FIG. 8, a variant of the punching apparatus 1 of the invention is illustrated which differs from the embodiment described above and illustrated in FIGS. 1 to 7, for the punching tool 23 that comprises a single-body punch or cutting tool provided with a second connecting end 52 connected to the first connecting end 9 of the beating element 7 and a second operating end 56 opposite the second connecting end 52 and adapted to interact by means of the cutting end 56*a* with the piece 100. The second operating end 56 is substantially the same as that of the punch tip 33.

The second connecting end 52 comprises the stopping cavity 54 inside which the second end 12 of the stopping element 10 is slidably inserted, which is slidable inside said stopping cavity 54 during the movement of the punch 23 between the initial adjustment position A and the final adjustment position B.

At an opening of the stopping cavity 54 a second stopping system 35 is provided, which is adapted to abut the first stopping system 22 of the stopping element 10 in the final adjustment position B.

The operation of this variant of the punching apparatus 1 is substantially the same as that of the embodiment of FIGS. 1 to 7.

Figure 9:
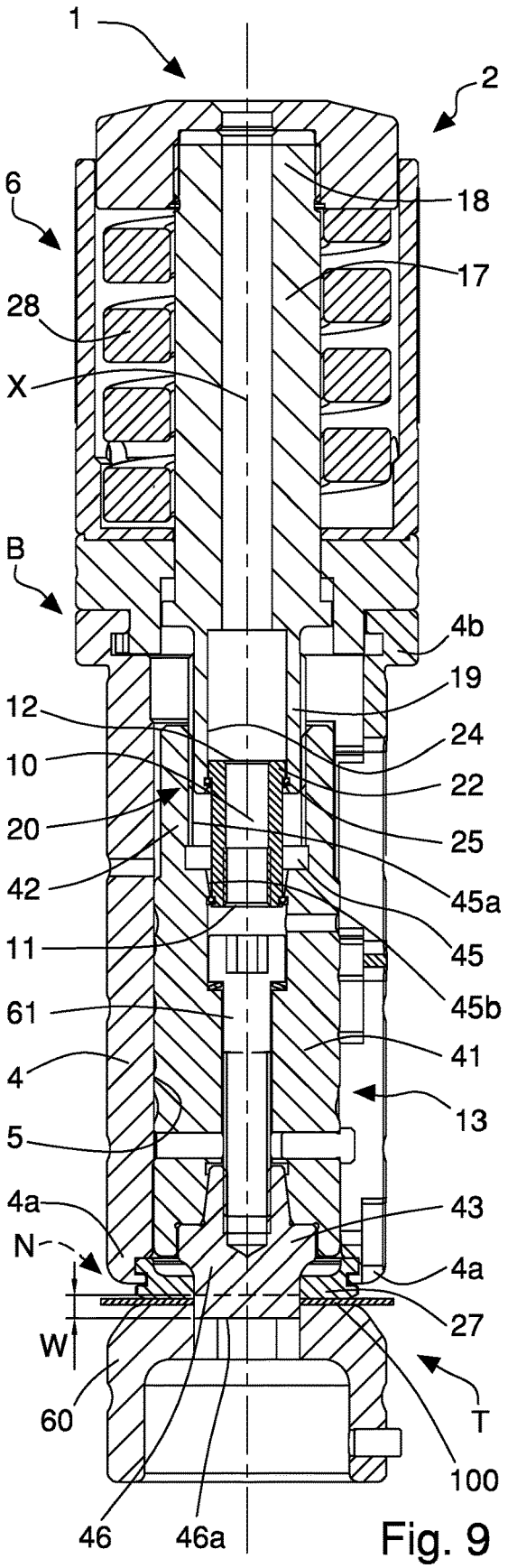
FIG. 9 is a section as in FIG. 2 illustrating another variant of the punching apparatus of the invention illustrating a beating element connected to the punching element comprising a punch tip holder supporting a punch tip in the final adjustment position and in the operating external position.

FIG. 9 illustrates in section another variant of the punching apparatus 1 of the invention which differs from the embodiment described above and illustrated in FIGS. 1 to 7 in that the connecting cavity 45 is made in the second connecting end 42 of the punching tool 13 and comprises an outer portion 45*a*, threaded and adapted to receive and engage the first connecting end 19, externally threaded, of the beating element 17, and an inner portion 45*b* adapted to receive and fixed to the first end 11 of the stopping element 10. The second end 12 of the stopping element is slidably housed in the stopping cavity 24 made in the first connecting end 19 of the beating element 17.

At the opening of the stopping cavity 24 a second stopping system 45 is provided, adapted to abut the first stopping system 22 of the stopping element 10 in the final adjustment position B.

The beating element 17 also comprises the first operating end 18 adapted to interact with the ram of the punching machine.

The punching tool 13 comprises a punch tip holder 41 or adapter provided with the second connecting end 42 and a punch tip 43 or cutting tip that is reversibly fixed to the punch tip holder 41 on the opposite side to the second connecting end 42 and provided with the second operating end 46 or cutting end adapted to interact with the piece 100 with the cutting end 36*a*.

Apart from the configuration of the second connecting end 42, the punch tip holder 41 and the punch tip 43 of this variant are substantially identical to the embodiment of FIGS. 1 to 7.

The operation of this other variant of the punching apparatus 1 is substantially the same as that of the embodiment of FIGS. 1 to 7.

The invention claimed is:

1. A punching apparatus for a punching machine, the punching apparatus comprising:

a punch holder; and a punching tool, wherein said punch holder comprises a guiding body, said guiding body provided with a mounting cavity suitable to slidably receive said punching tool, and a driving assembly connected to said guiding body and provided with a beating element having a first operating end suitable to interact with a ram of the punching machine and a first connecting end coupled to a second connecting end of said punching tool by means of a threaded coupling, said threaded coupling enabling a relative rotation between said beating element and said punching tool for a linear movement thereof with respect to said beating element along an adjustment stroke between an initial adjustment position, in which an engagement portion of said threaded coupling has a maximum length, and a final adjustment position, in which said engagement portion has a minimum length, and wherein said punching apparatus further comprises a stopping element having a first stopping end and a second stopping end, said first stopping end being fixed inside a connecting cavity made in one of said first and second connecting ends and arranged to receive another of said first and second connecting ends, said second stopping end being inserted in a stopping cavity made in said another of said first and second connecting ends and sliding inside the stopping cavity during the linear movement of said punching tool between the initial adjustment position and the final adjustment position, said second stopping end being provided with a first stopping system arranged to abut a second stopping system provided at an opening of the stopping cavity so as to prevent said stopping element from disengaging from the stopping cavity and to stop the adjustment stroke of said punching tool in the final adjustment position.

2. The punching apparatus according to claim 1, wherein said punching tool comprises a second operating end, opposite to said second connecting end, said second operating end provided with a cutting end capable of interacting with a piece to be punched and having a defined sharpening length that is longer than the adjustment stroke of said punching tool.

3. The punching apparatus according to claim 1, wherein said punching tool comprises a punch tip holder provided with a second connecting end and a punch tip reversibly fixed to said punch tip holder on an opposite side to said second connecting end and provided with a second operating end, which is opposite to said second connecting end, provided with a cutting end and adapted to interact with a piece to be punched.

4. The punching apparatus according to claim 1, wherein said punching tool comprises a single-body punch provided with a second connecting end and with a second operating end, which is opposite to said second connecting end, provided with a cutting end and adapted to interact with a piece to be punched.

5. The punching apparatus according to claim 1, wherein said beating element is driven by the ram in order to linearly move said punching tool along a longitudinal axis with respect to said guiding body according to a working stroke comprised between a non-operating internal position, in which a second operating end of said punching tool, which is opposite to said second connecting end and adapted to interact with a piece to be punched, is contained inside said punch holder, and an operating external position, in which said second operating end protrudes from said punch holder and penetrates with a respective cutting end into an underlying punching die so as to punch the piece.

6. The punching apparatus according to claim 1, wherein said punch holder further comprises an extractor element, which is fixed to a first end part of said guiding body from which said punching tool protrudes, is adapted to keep a piece in abutment against an underlying punching die and is provided with a respective opening for exit of a second operating end of said punching tool that is opposite to said second connecting end of said punching tool and adapted to interact with the piece to be punched.

7. The punching apparatus according to claim 6, wherein said beating element is driven by the ram in order to linearly move said punching tool along a longitudinal axis with respect to said guiding body according to a working stroke comprised between a non-operating internal position, in which said second operating end of said punching tool, which is opposite to said second connecting end and adapted to interact with the piece to be punched, is contained inside said punch holder, and an operating external position, in which said second operating end protrudes from said punch holder and penetrates with a respective cutting end into an underlying punching die so as to punch the piece, and wherein said stopping element is sized and fixed with said first stopping end inside the connecting cavity in such a way that said punching tool also in the final adjustment position with respect to said beating element and in the operating external position with respect to said guiding body does not collide with said second operating end against said extractor element.

8. The punching apparatus according to claim 1, wherein the connecting cavity is made in said first connecting end of said beating element and comprises an outer portion, which is threaded and adapted to receive and engage said second connecting end, externally threaded, of said punching tool, and an inner portion adapted to receive and fixed to said first stopping end of said stopping element, said second stopping end of said stopping element being slidably housed in the stopping cavity made in said second connecting end of said punching tool.

9. The punching apparatus according to claim 1, wherein the connecting cavity is made in said second connecting end of said punching tool and comprises an outer portion, which is threaded and adapted to receive and engage said first connecting end, externally threaded, of said beating element, and an inner portion adapted to receive, and fixed to, said first stopping end of said stopping element, said second stopping end of said stopping element being slidably housed in the stopping cavity made in said first connecting end of said beating element.

10. The punching apparatus according to claim 1, wherein said stopping element has a cylindrical shape.

11. The punching apparatus according to claim 10, wherein said first stopping system of said stopping element comprises an annular protrusion made on an edge of said second stopping end of said stopping element.

12. The punching apparatus according to claim 1, wherein said second stopping system comprises at least one elastic ring that is housed in a respective inner annular groove made at the opening of the stopping cavity.

13. The punching apparatus according to claim 1, wherein said driving assembly comprises a base element that is fixed to a second end part of said guiding body, opposite to a first end part from which said punching tool protrudes, said base element being arranged to slidably guide said beating element along a longitudinal axis, and an elastic element interposed between said base element and said first operating end of said beating element to return said beating element to a raised position so as to extract said punching tool from a piece after the punching of the piece.

* * * * *